US008830214B2

(12) United States Patent
Mahajan et al.

(10) Patent No.: US 8,830,214 B2
(45) Date of Patent: Sep. 9, 2014

(54) DITHERED POWER MATCHING OF LASER LIGHT SOURCES IN A DISPLAY DEVICE

(75) Inventors: Amit Mahajan, Bangalore (IN); Narayanan Venkatasubramanian, Bangalore (IN)

(73) Assignee: Prysm, Inc., San Jose, CA (US)

( * ) Notice: Subject to any disclaimer, the term of this patent is extended or adjusted under 35 U.S.C. 154(b) by 754 days.

(21) Appl. No.: 13/098,010

(22) Filed: Apr. 29, 2011

(65) Prior Publication Data

US 2012/0176347 A1 Jul. 12, 2012

(30) Foreign Application Priority Data

Jan. 6, 2011 (IN) ..... 29/DEL/2011

(51) Int. Cl.

| | |
|---|---|
| ***G06F 3/038*** | (2013.01) |
| ***G09G 3/00*** | (2006.01) |
| ***G09G 3/02*** | (2006.01) |
| ***G09G 5/00*** | (2006.01) |

(52) U.S. Cl.

CPC ..... *G09G 5/00* (2013.01); *G09G 2330/08* (2013.01); *G09G 3/002* (2013.01); *G09G 3/025* (2013.01); *G09G 2320/045* (2013.01)

USPC ..... 345/204; 345/32; 359/201.1; 359/443; 353/29

(58) Field of Classification Search

CPC ..... H04N 9/3135; H04N 9/3155; H04N 3/08; H04N 9/3164; G09G 3/02; G09G 2320/0693; G09G 3/2011; G09G 3/2014; G09G 2320/0238; G09G 3/2081; G02B 26/101; G02B 26/127; G02B 26/105; G02B 26/123

USPC ..... 345/32, 84, 690; 359/443, 201.1, 201.2, 359/202.1, 204.2, 210.1, 456, 460; 353/29

See application file for complete search history.

(56) References Cited

U.S. PATENT DOCUMENTS

| | | | | |
|---|---|---|---|---|
| 6,552,735 | B1 * | 4/2003 | Dehmlow | 345/690 |
| 2006/0273997 | A1 * | 12/2006 | Nathan et al. | 345/78 |
| 2008/0068295 | A1 * | 3/2008 | Hajjar | 345/3.2 |

* cited by examiner

*Primary Examiner* — Koosha Sharifi-Tafreshi
(74) *Attorney, Agent, or Firm* — Patterson & Sheridan, LLP

(57) ABSTRACT

A technique for managing image quality in a laser-based imaging system is provided. Laser light sources are organized into two or more groups, and optical output power of a light source group containing an under-performing laser is matched to that of the under-performing laser, while the optical output power of the light sources in the remaining groups is not. The output of the laser light sources in each group is interleaved with the output of the laser light sources in the other groups, so that perceptual uniformity of a displayed image is maintained when the display is viewed from an appropriate viewing distance.

23 Claims, 4 Drawing Sheets

FIG. 2

DITHERED POWER MATCHING OF LASER LIGHT SOURCES IN A DISPLAY DEVICE

CROSS-REFERENCE TO RELATED APPLICATIONS

This application claims the priority benefit of the Indian Patent Application filed on Jan. 6, 2011 and having serial number 29/DEL/2011. The subject matter of this related application is hereby incorporated herein by reference.

BACKGROUND OF THE INVENTION

1. Field of the Invention

Embodiments of the present invention relate generally to image display devices and, more specifically, to systems and methods for adjusting optical power output for multiple light sources in a display device to produce a more uniform image.

2. Description of the Related Art

Electronic display systems are commonly used to display information from computers and other sources. Typical display systems range in size from small displays used in mobile devices to very large displays, such as tiled displays, that are used to display images to thousands of viewers at one time. Multiple light sources are commonly used in such displays. For example, in laser-phosphor displays (LPDs), multiple lasers may be used to simultaneously "paint" different phosphor-containing regions to produce an image for a viewer, where the optical output energy of each laser paints a different phosphor-containing region of the display.

Because the human eye can readily perceive small differences in brightness uniformity of a displayed image, the use of multiple light sources in a display system can produce visual artifacts in an image when the output of each light source is not tightly controlled. Differences in brightness as small as 1% within 1 degree angle subtended at the eye between adjacent light sources are apparent to a viewer, so each light source of a display system must be calibrated to generate light energy with a variation of less than 1% from the other light sources. Otherwise, display system brightness will appear non-uniform. For example, in LPDs, in which each laser may illuminate a different row of pixels on a display screen, lines of higher or lower brightness may be apparent to the viewer if the mismatch in laser power is greater than approximately 1% within 1 degree angle subtended at the eye.

Due to manufacturing variations between each laser and drift in the performance of each laser over time, such display devices can frequently have one or more under-performing lasers, which produce regions on the display screen that are noticeably darker to the viewer. To preserve uniformity of image brightness, all other lasers in the display device can be reduced in power to match the optical power output of the under-performing laser. However, this approach can severely reduce image brightness, which is an important component of perceived image quality.

As the foregoing illustrates, there is a need in the art for an improved way to provide uniform optical power adjustment between multiple laser light sources in a display device without unduly dimming and reducing the perceived quality of the image being displayed.

SUMMARY OF THE INVENTION

One embodiment of the present invention sets forth a method for managing image quality in a laser-based imaging system. Laser light sources are organized into two or more groups, and optical output power of a laser group containing an under-performing laser is adjusted to that of the under-performing laser, while the optical output power of the lasers in the remaining groups is not. Because the output of the laser light sources in each group is interleaved with the output of the laser light sources in the other groups, perceptual uniformity of a displayed image is maintained when the display is viewed from an appropriate viewing distance.

One advantage of the present invention is that a brighter and more uniform image can be produced by an image display device having multiple laser light sources when one of the light sources suffers from degraded performance.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

For clarity, identical reference numbers have been used, where applicable, to designate identical elements that are common between figures. It is contemplated that features of one embodiment may be incorporated in other embodiments without further recitation.

DETAILED DESCRIPTION

Figure 1:
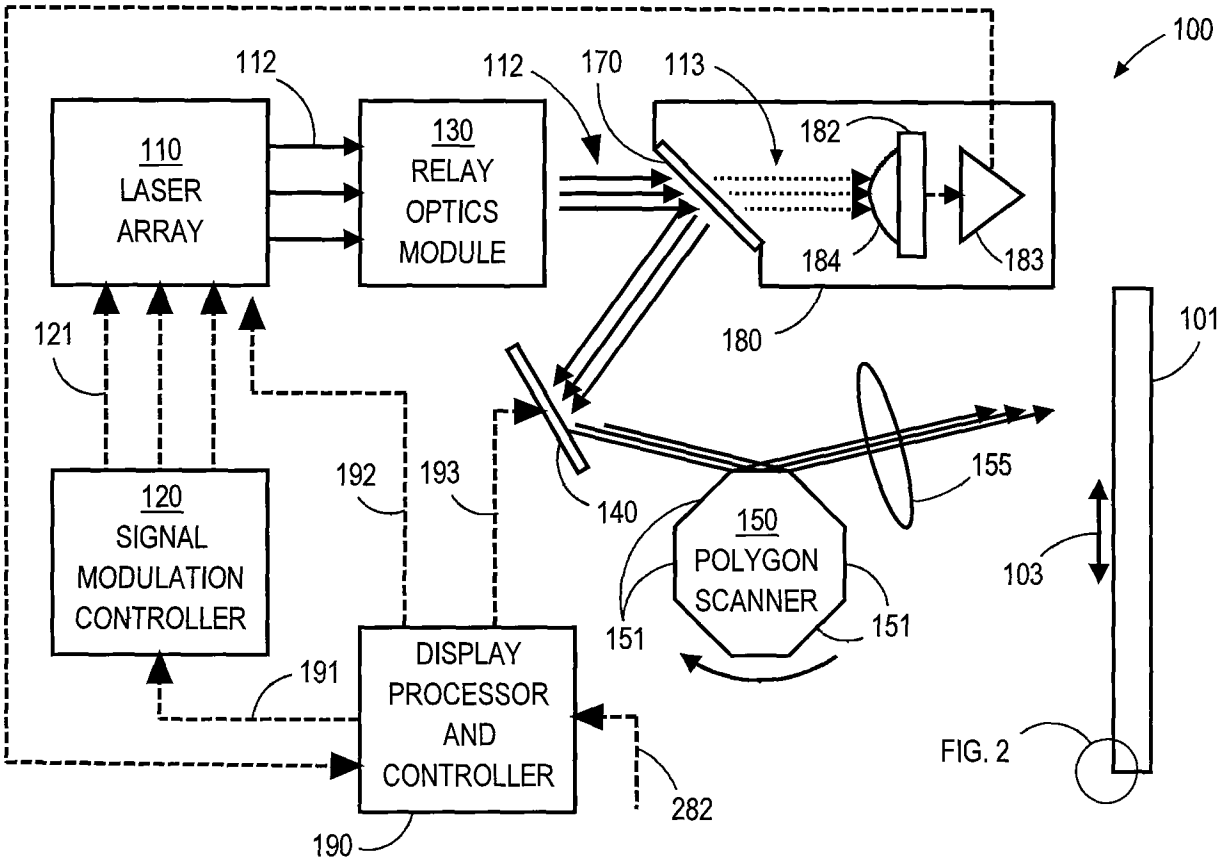
FIG. 1 schematically illustrates a display system configured to implement one or more aspects of the invention.

FIG. 1 schematically illustrates a display system 100 configured to implement one or more aspects of the invention. Display system 100 is a laser-phosphor display (LPD) that uses multiple laser light sources for illuminating individual pixels of a fluorescent screen 101, and is configured to maintain image quality when one of the light sources suffers from degraded performance by using dithered power matching of two or more groups of the laser light sources. Display system 100 includes fluorescent screen 101, a signal modulation controller 120, a laser array 110, a relay optics module 130, a mirror 140, a polygon scanner 150, an imaging lens 155, a beam splitter 170, a detector assembly 180, and a display processor and controller 190, configured as shown.

Figure 2:
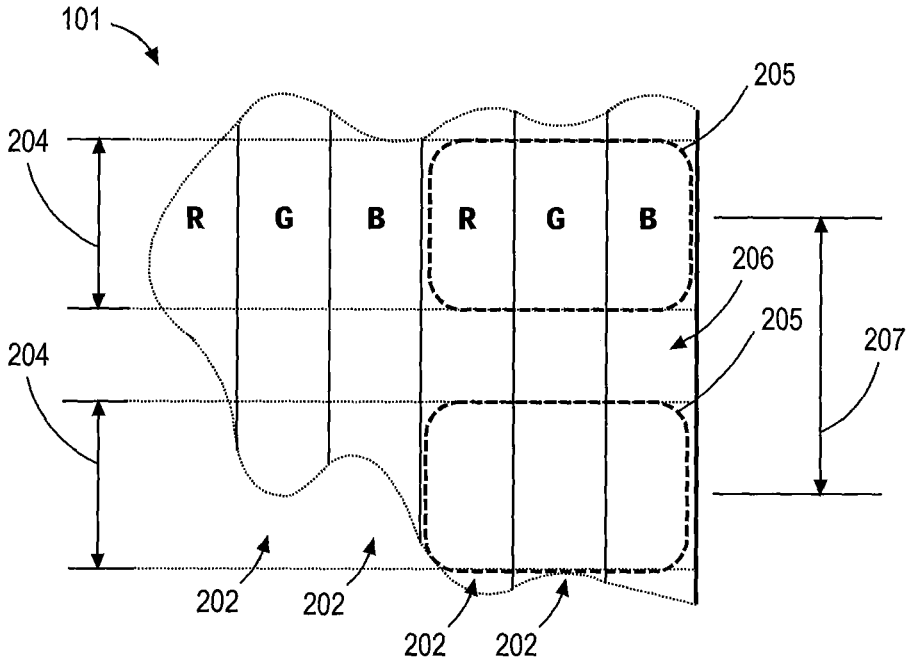
FIG. 2 is a partial schematic diagram of the portion of the fluorescent screen indicated in FIG. 1 and illustrates pixel elements, each including a portion of three different-colored phosphor stripes.

Fluorescent screen 101 includes a plurality of phosphor stripes made up of alternating phosphor stripes of different colors, e.g., red, green, and blue, where the colors are selected so that in combination they can form white light and other colors of light. FIG. 2 is a partial schematic diagram of the portion of fluorescent screen 101 indicated in FIG. 1. FIG. 2 illustrates pixel elements 205, each including a portion of three different-colored phosphor stripes 202. By way of example, in FIG. 2 phosphor stripes 202 are depicted as red, green, and blue phosphor stripes, denoted R, G, and B, respectively. Phosphor stripes 202 may be separated by small gaps, but such gaps are not shown for clarity. The portion of the phosphor stripes 202 that belong to a particular pixel element 205 is defined by the laser scanning paths 204, as shown. In FIG. 2, a significant gap 206 is depicted between laser scanning paths 204, and such gaps 206 may be as wide as or wider than the width of laser scanning paths 204. Alternatively, substantially no gaps may be present between laser scanning paths 204. In either case, pixel pitch 207, which is the center-to-center distance between adjacent pixel elements 205, is unaffected.

An image is formed on fluorescent screen 101 by directing laser beams 112 (shown in FIG. 1) along the laser scanning paths 204 and modulating the output intensity of laser beams 112 to deliver a desired amount of optical energy to each of the red, green, and/or blue phosphor stripes 202 found within each pixel element 205. Each pixel element 205 outputs light for forming a desired image by the emission of visible light created by the selective laser excitation of each phosphor-containing stripe in a given pixel element 205. Thus, modulation of the optical energy applied to red, green, and blue portions of each pixel element 205 by the lasers controls the composite color and image intensity at each pixel element 205. In the embodiment illustrated in FIG. 2, one dimension of the pixel element is defined by the width of the three phosphor stripes 202, and the orthogonal dimension is controlled by the laser beam spot size and/or the pixel pitch 207. In other implementations, both dimensions of pixel element 205 may be defined by physical boundaries, such as separation of phosphor stripes 202 into rectangular phosphor-containing regions. In one embodiment, each of phosphor stripes 202 is spaced at about a 500 μm to about 550 μm pitch, so that the width of pixel element 205 is on the order of about 1500 μm.

On a display screen, the human eye can generally detect differences in brightness as small as about 1%. Thus, to produce an image on fluorescent screen 101 that appears to have uniform brightness to the human eye, the output intensity of each laser beam 112 must be controlled to an accuracy of about 1% with respect to the other laser beams 112. However, when fluorescent screen 101 is viewed from a suitable distance, bright and dark regions adjacent to each other on fluorescent screen 101, such as two adjacent scanning paths 204, will appear to the human eye as the average brightness of the two regions and not as two distinct regions of non-uniform brightness. The minimum viewing distance at which this effect takes place is a function of spatial frequency, e.g., contrast cycles per degree of viewing angle, and the contrast threshold function of the human eye. Thus, for fluorescent screen 101, such a minimum viewing distance is determined by the dimensions, i.e., height and width, of pixel elements 205, as well as the difference in brightness between two adjacent pixel elements 205.

As noted above, the human eye averages the colors and/or brightness of two adjacent regions on a display device when such regions have a small apparent size. Because of this, a concept known as "dithering," in which a digital display screen uses two colors to create the appearance of a third, or average, color, enables a digital display screen to produce a smooth appearance to an otherwise abrupt transition in color. According to embodiments of the invention, dithered power matching of laser light sources in a display device may be used to produce an image with uniform brightness when one or more of the lasers are operating at a lower power output given a common input value. Specifically, laser light sources used to illuminate pixel elements 205 of fluorescent screen 101 are organized into two or more groups, where the optical output power of a group of light sources containing an under-performing laser is adjusted to that of the under-performing laser, and the optical output power of the light sources in the one or more remaining groups is adjusted to a higher optical output power level. In another embodiment, given the same two or more groupings, the output of the laser light sources in each group is interleaved with the output of the laser light sources in the other groups, so that perceptual uniformity of a displayed image is maintained when the display is viewed from an appropriate viewing distance.

Figure 3:
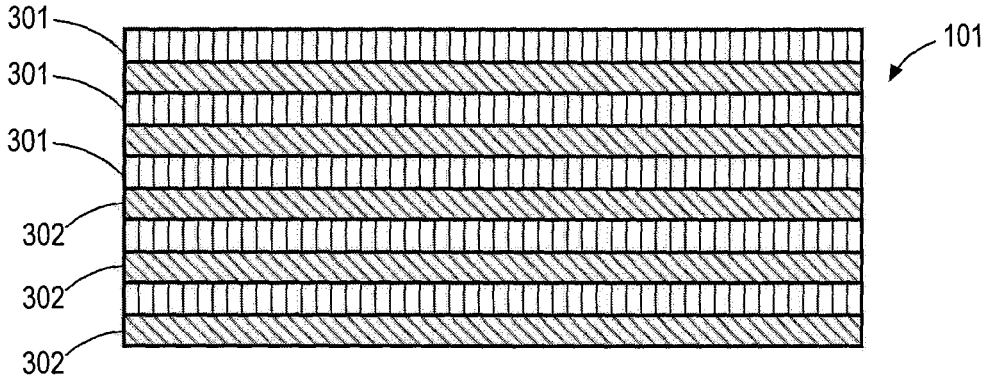
FIG. 3 illustrates a fluorescent screen illuminated by interleaved output of two groups of laser light sources from a laser array, according to an embodiment of the invention.

FIG. 3 illustrates fluorescent screen 101 illuminated by interleaved output of two groups of laser light sources from laser array 110, according to an embodiment of the invention. A first laser group 401 (illustrated in FIG. 4) from laser array 110 is selected to illuminate a plurality of regions 301 (denoted by vertical cross-hatching) on fluorescent screen 101 and a second laser group 402 (illustrated in FIG. 4) from laser array 110 is selected to illuminate a second plurality of regions 302 (denoted by diagonal cross-hatching) on fluorescent screen 101. Regions 301 and regions 302 each include a plurality of laser scanning paths 204. As shown, the laser scanning paths 204 that correspond to regions 301 are interleaved with the laser scanning paths 204 that correspond to regions 302, so that regions 301 are disposed on the screen in an alternating fashion between regions 302 and vice-versa. For clarity, the individual phosphor-containing stripes 202 of fluorescent screen 101 are omitted from FIG. 3. In addition, fluorescent screen 101 generally includes a much larger number of regions 301 and 302 than are depicted in FIG. 3.

The optical output level of each laser included in first laser group 401 is adjusted to a first output level and the optical output level of each laser included in second laser group 402 is adjusted to a second output level. Because regions 301 and regions 302 are interleaved, the first and second optical output levels can be significantly different and still produce a perceptually uniform image to a viewer when fluorescent screen 101 is viewed from a suitable viewing distance, due to the dithering of the two optical output levels. Specifically, in one embodiment, first laser group 401 includes an under-performing laser that cannot produce as high an optical output as the other lasers in first laser group 401. To ensure image brightness uniformity, the power level of all lasers in first laser group 401 are adjusted to the power level of the under-performing laser. In contrast, the lasers in second laser group 402 are adjusted to a higher power level. In one embodiment, the higher power level corresponds to a reference power level, i.e., the desired maximum power level of the lasers for laser array 110. Alternatively, the higher power level may be selected to compensate for the reduced power level at which first laser group is operating. For example, the maximum power level of the under-performing laser in laser group 401 may be at 5% below the desired maximum power level, and the maximum power level of the remaining lasers in laser group 401 are adjusted to this same level. In order to compensate for the resultant reduction in image brightness, the lasers in second laser group 402 may be adjusted to a maximum power level that is 5% above the reference power level, i.e., the desired maximum power level for lasers in laser array 110. Consequently, the total image brightness of fluorescent screen 101 can be held constant even though one of the lasers in laser array 110 is under-performing by a significant amount.

Figure 4:
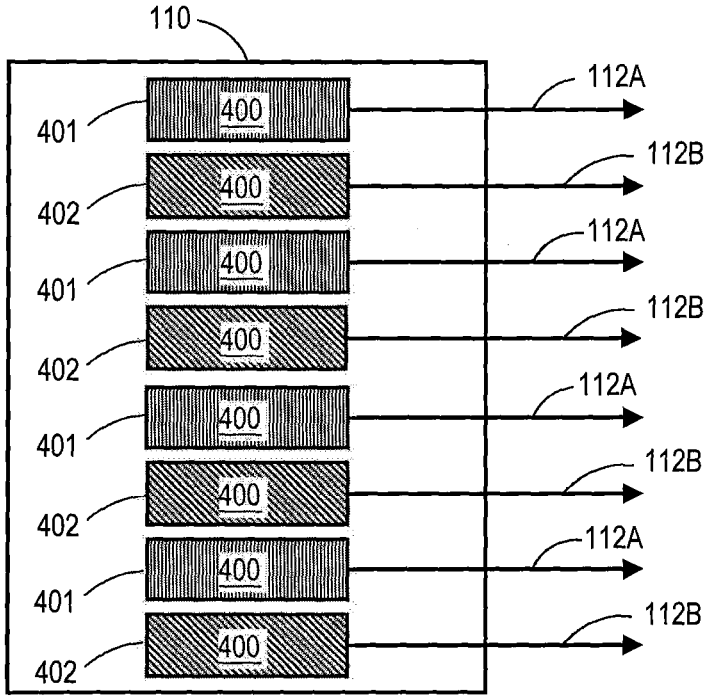
FIG. 4 schematically illustrates a laser array, according to one embodiment of the invention.

FIG. 4 schematically illustrates laser array 110, according to one embodiment of the invention. Laser array 110 includes multiple lasers 400, e.g., 5, 10, 20, or more, and generates multiple laser beams 112A, 112B to simultaneously scan fluorescent screen 101 as shown in FIG. 1. Laser beams 112A, 112B are modulated light beams that are scanned across fluorescent screen 101 along two orthogonal directions, e.g., horizontally and vertically, in a raster scanning pattern to produce an image on fluorescent screen 101 for a viewer. In one embodiment, lasers 400 are ultraviolet (UV) lasers producing light with a wavelength between about 400 nm and 450 nm. In the embodiment illustrated in FIG. 4, the lasers 400 that are organized into first laser group 401 (denoted by vertical cross-hatching) are physically interleaved with the lasers 400 that are organized into second laser group 402 (denoted by diagonal cross-hatching), so that the outputs of first laser group 401, i.e., laser beams 112A, are interleaved with the outputs of second laser group 302, i.e., laser beams 112B. Consequently, regions disposed on fluorescent screen 101 are illuminated in an alternating fashion by the outputs of first laser group 401 and second laser group 402.

Due to manufacturing variations and changes in temperature during operation, the optical power output of each laser 400 may be different and/or may drift over time. In addition, performance of each laser 400 may degrade over the lifetime of display system 100. Periodic and/or continuous calibration may be performed on each of lasers 400 in order to compensate for manufacturing variation and drift and keep mismatch between lasers from being noticeable to the viewer, i.e., less than about 1%. For example, servo control mechanisms may be used that scan a designated servo beam over the screen by the same optical scanning components that scan laser beams 112 across fluorescent screen 101. This designated servo beam is used to provide servo feedback control over the scanning excitation beams, i.e., laser beams 112, to ensure proper optical alignment and accurate delivery of optical pulses during normal display operation. A servo control mechanism suitable for providing continuous calibration of the optical power output of lasers 400 is described in greater detail in co-pending provisional patent application 61/352,302, filed Jun. 7, 2010. However, as the optical power output of one or more of lasers 400 degrades over time, the total brightness of display system 100 must be reduced to ensure image brightness uniformity.

According to embodiments of the invention, to minimize losses in the brightness of display system 100 when a laser in laser array 110 degrades in performance, lasers 400 are organized into two or more laser groups, where the lasers in a particular laser group are adjusted to a single optical output power but each laser group may be set at a different optical output power from the other laser groups. For example, in the embodiment illustrated in FIG. 4, the lasers of first laser group 401 are adjusted to a first optical output power and the lasers of second laser group 402 are adjusted to a second optical output power, where the first and second optical output powers are not necessarily equal. When a laser in laser array 100 degrades in performance, only one group of lasers in laser array 100 is reduced to the power level of the under-performing laser, rather than all lasers in laser array 110. Thus, when laser array 110 consists of two laser groups, the loss in the brightness of display system 100 when a laser in laser array 110 degrades in performance is reduced by half. It is noted that the number of groups into which laser array 110 may be organized may be greater than two, which further reduces the amount of image brightness lost when a laser in laser array 110 degrades in performance. The number of laser groups into which laser array 110 can be organized is a function of minimum viewing distance, the width of pixel elements 205 and pixel pitch 207, and the contrast threshold function of the human eye. Procedures for determining the number of laser groups into which laser array 110 is organized are described below in conjunction with FIG. 6.

Signal modulation controller 120 controls and modulates the lasers in laser array 110 so that laser beams 112 are modulated at the appropriate output intensity to produce a desired image on fluorescent screen 101. Signal modulation controller 120 may include a digital image processor that generates laser modulation signals 121. Laser modulation signals 121 include the three different color channels and are applied to modulate the lasers in laser array 110. In some embodiments, the output intensity of the lasers is modulated by varying the input current or input power to the laser diodes. In some embodiments, the modulation of laser beams 112 may include pulse modulation techniques to produce desired gray-scales in each color, a proper color combination in each pixel, and a desired image brightness. Laser modulation signals 121 also include the appropriate scaling so that the lasers in a particular laser group making up laser array 110 are adjusted in optical output power. For example, if a laser in laser group 401 has degraded to a maximum optical output of 80% of nominal, then laser modulation signals 121 to all other lasers in laser group 401 are scaled down to 80% to produce the same optical output as the under-performing laser.

Returning to FIG. 1, relay optics module 130, mirror 140, polygon scanner 150, and imaging lens 155 direct laser beams 112 to fluorescent screen 101 and scan laser beams 112 horizontally and vertically across fluorescent screen 101 in a raster-scanning pattern to produce an image. For the sake of description, "horizontal" with respect to fluorescent screen 101 in FIG. 1 is defined as parallel to arrow 103 and "vertical" with respect to fluorescent screen 101 is defined as perpendicular to the plane of the page. Relay optics module 130 is disposed in the optical path of laser beams 112 and is configured to shape laser beams 112 to a desired spot shape and to direct laser beams 112 into a closely spaced bundle of somewhat parallel beams. Depending on the specific configuration of display system 100, laser beams 112 may be slightly diverging or converging when exiting relay optics module 130. Beam splitter 170 is a partially reflective mirror or other beam-splitting optic, and directs the majority, e.g., 99%, of the optical energy of laser beams 112 to mirror 140 while allowing the remainder of said optical energy, i.e., sample beams 113, to enter detector assembly 180 for measurement. The organization and operation of detector assembly 180 is described below. Mirror 140 is a reflecting optic that can be quickly and precisely rotated to a desired orientation, such as a galvanometer mirror, a microelectromechanical system (MEMS) mirror, etc. Mirror 140 directs laser beams 112 from beam splitter 170 to polygon scanner 150, where the orientation of mirror 140 partly determines the vertical positioning of laser beams 112 on fluorescent screen 101. Polygon scanner 150 is a rotating, multi-faceted optical element having a plurality of reflective surfaces 151, e.g., 5 to 10, and directs laser beams 112 through imaging lens 155 to fluorescent screen 101. The rotation of polygon scanner 150 sweeps laser beams 112 horizontally across the surface of fluorescent screen 101 and further defines the vertical positioning of laser beams 112 on fluorescent screen 101. Imaging lens 155 is designed to direct each of laser beams 112 onto the closely spaced pixel elements 205 on fluorescent screen 101.

In operation, the positioning of mirror 140 and the rotation of polygon scanner 150 horizontally and vertically scan laser beams 112 across fluorescent screen 101 so that all of pixel elements 205 are illuminated as desired. To wit, as polygon scanner 150 rotates one of reflective surfaces 151 through incident laser beams 112, each of laser beams 112 is directed to sweep horizontally across fluorescent screen 101 from one side to the other, each laser beam following a different vertically displaced laser scanning path 204, thereby illuminating the pixel elements 205 disposed in these laser scanning paths 204 (laser scanning paths 204 and pixel elements 205 are illustrated in FIG. 2). Given N lasers in laser array 110 and N laser beams 112, a "swath" consisting of N laser scanning paths 204 is illuminated as polygon scanner 150 rotates one of reflective surfaces through incident laser beams 112, where the N lasers may be organized into sub-groups, such as laser group 401 and laser group 402. Because each of reflective surfaces 151 is canted at a different angle with respect to the horizontal, i.e., the plane of the page, when polygon scanner 150 rotates a subsequent reflective surface 151 through incident laser beams 112, the beams sweep horizontally across fluorescent screen 101 at a different vertical location. Thus, given N laser beams and M reflective surfaces 151 of polygon scanner 150, one rotation of polygon scanner 150 "paints" M×N rows of pixels. If fluorescent screen 101 is made up of more than M×N horizontal rows of pixels, then mirror 140 can be repositioned so that another block of M×N horizontal rows of pixels will be painted during the next rotation of polygon scanner 150. Once all pixels of fluorescent screen 101 have been illuminated, mirror 140 returns to an initial or top position and the cycle is repeated in synchronization with the refresh rate of the display.

In some embodiments, the lasers 400 are configured to illuminate rows of pixels in each block, i.e., laser scanning paths 204, that are adjacent to each other on fluorescent screen 101. In such embodiments, mirror 140 is repositioned after each rotation of polygon scanner 150 so that a subsequent block of M×N horizontal rows of illuminated pixels is disposed adjacent to the previously illuminated block of M×N horizontal rows until all rows of pixels on fluorescent screen 101 have been illuminated and mirror 140 returns to the initial or top position.

Figure 5:
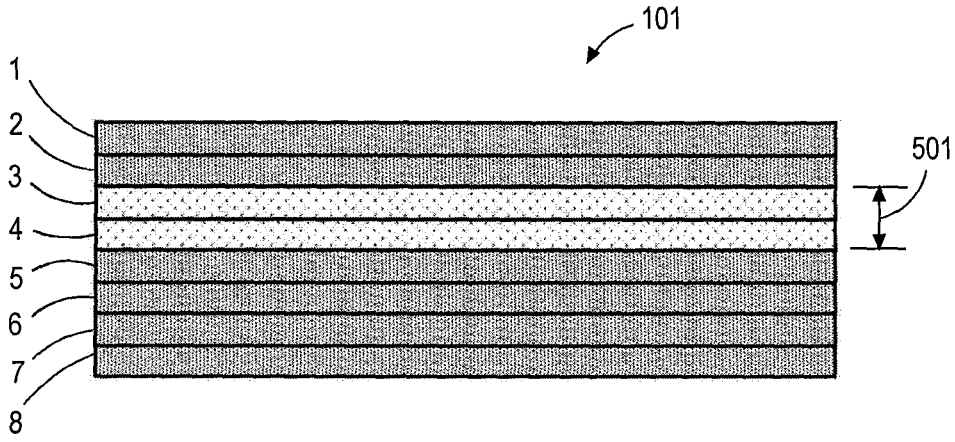
FIG. 5 schematically illustrates a portion of a fluorescent screen illuminated by blocks of laser scanning paths that are each configured to illuminate rows of pixels that are not adjacent to each other, according to an embodiment of the invention.

In other embodiments, lasers 400 are configured to illuminate rows of pixels in each block that are not adjacent to each other and are instead separated by one or more unilluminated rows of pixels. In such embodiments, one or more blocks of M×N horizontal rows of illuminated pixels are interleaved with other blocks of M×N horizontal rows of illuminated pixels. Thus, the rows of pixels illuminated during one rotation of polygon scanner 150 are not adjacent to each other and are instead spaced between intermediary rows of pixels that belong to a different block of M×N rows. The intermediary rows of pixels are illuminated when mirror 140 is repositioned. FIG. 5 illustrates one such embodiment.

FIG. 5 schematically illustrates a portion of fluorescent screen 101 illuminated by blocks of laser scanning paths that are each configured to illuminate rows of pixels that are not adjacent to each other, according to an embodiment of the invention. For clarity, only the first eight pixel rows on screen 101 are shown. Pixel rows 1, 3, 5, and 7 are included in a first block of M×N pixel rows and are illuminated by lasers 400 of laser array 110 during one rotation of polygon scanner 150. Pixel rows 2, 4, 6, and 8 are included in a second block of M×N pixel rows and, after mirror 140 is repositioned, are illuminated by lasers 400 during a second rotation of polygon scanner 150. In such an embodiment, an under-performing laser will illuminate 2 adjacent horizontal rows of pixels on fluorescent screen 101. For example, in FIG. 5, an under-performing laser illuminates pixel row 3 during a first rotation of polygon scanner 150 and pixel row 4 during a subsequent rotation of polygon scanner 150. Thus, the resultant dimmer region on fluorescent screen 101 has a width 501 of two times the pixel pitch 207 of fluorescent screen 101. FIG. 5 illustrates fluorescent screen 101 when lasers 400 are configured to illuminate rows of pixels that are separated by a single row of unilluminated pixels. However, it is understood that in a given block, lasers 400 may be configured to illuminate rows of pixels that are separated by one or more unilluminated rows of pixels, the unilluminated rows of pixels being illuminated during subsequent rotations of polygon scanner 150.

Display processor and controller 190 is configured to perform control functions for and otherwise manage operation of display system 100. Such functions include receiving image data of an image to be generated, providing an image data signal 191 to signal modulation controller 120, providing laser control signals 192 to laser array 110, producing scanning control signals 193 for controlling and synchronizing polygon scanner 150 and mirror 140, performing calibration functions, and organizing lasers 400 into laser groups, according to embodiments of the invention described herein. Specifically, display processor and controller 190 is configured to individually modulate power applied to each laser in laser array 110 in order to adjust the output intensity of each light source. Thus, display processor and controller 190 can match the output of a group of lasers containing an under-performing laser to the power output of the under-performing laser, and can match other groups of lasers to a different desired output power level.

Display processor and controller 190 may include one or more suitably configured processors, including a central processing unit (CPU), a graphics processing unit (GPU), a field-programmable gate array (FPGA), an integrated circuit (IC), an application-specific integrated circuit (ASIC), or a system-on-a-chip (SOC), among others, and is configured to execute software applications as required for the proper operation of display system 100. Display processor and controller 190 may also include one or more input/output (I/O) devices and any suitably configured memory for storing instructions for controlling normal and calibration operations, according to embodiments of the invention. Suitable memory includes a random access memory (RAM) module, a read-only memory (ROM) module, a hard disk, and/or a flash memory device, among others.

Detector assembly 180 is configured to measure the actual output intensity of the lasers in laser array 110 during operation of display system 100 and may include a light detector 182 and a current-to-voltage converter circuit 183. By directly measuring the optical energy contained in each of sample beams 113 while display system 100 is in operation, drift in laser performance can be immediately compensated for and a more uniform image can be generated by display system 100. A detector assembly suitable for use as detect assembly 180 is described in greater detail in co-pending provisional patent application 61/352,302, filed Jun. 7, 2010.

Figure 6:
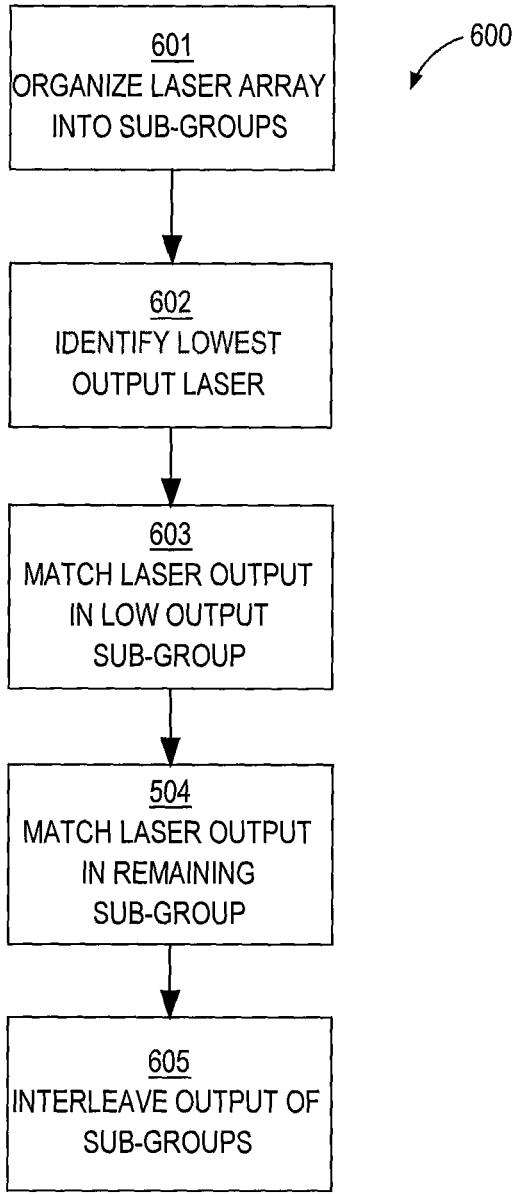
FIG. 6 is a flow chart that summarizes, in a stepwise fashion, a method for maintaining image quality when displaying an image with a display system having multiple light sources, according to embodiments of the invention.

FIG. 6 is a flow chart that summarizes, in a stepwise fashion, a method 600 for maintaining image quality when displaying an image with a display system having multiple light sources, according to embodiments of the invention. By way of illustration, method 600 is described in terms of an LPD-based electronic display device substantially similar in organization and operation to display system 100 in FIG. 1. However, other display devices having multiple laser-light sources may also benefit from the use of method 600. Although the method steps are described in conjunction with FIG. 6, persons skilled in the art will understand that any system configured to perform the method steps, in any order, falls within the scope of the present invention. Prior to the first step of method 600, a laser-output-measuring procedure may be performed, in which lasers 400 of laser array 110 are set to maximum output intensity, and the optical output power of each is measured by light detector 182. In this way, under-performing lasers in laser array 110 can be detected and their performance quantified.

The method begins at step 601, in which display processor and controller 190 organizes laser 400 of laser array 110 into m sub-groups of lasers, where m≥2, such as into first laser group 401 and second laser group 402. As illustrated in FIG. 4, the lasers of first laser group 401 and second laser group 402 are physically interleaved so that first laser group 401 and second laser group 402 illuminate regions 301 and 302 of fluorescent screen 101, respectively. The number m of sub-groups of lasers is selected by display processor and controller 190 as a function of minimum desired viewing distance from display system 100, width of regions on the viewing surface illuminated by the lasers, i.e., pixel pitch 207, the contrast threshold function of the human eye, and the maximum power difference between any two lasers in laser array 110, i.e., the difference in maximum output level between an under-performing laser in laser array 110 and the nominal maximum output level of lasers in laser array 110

In one embodiment, m is determined using Equations 1 and 2. Equation 1 is first used to find Δ, the maximum contrast variation between two lasers displaying the same color:

$$\Delta = \frac{\delta}{200 + \delta} \tag{1}$$

where δ is the maximum percentage variation of power between any two lasers in laser array 110. Equation 2 is then used to solve for m:

$$m = \left\lfloor \frac{D \times \pi}{360 \times ictf(\Delta) \times p} \right\rfloor \tag{2}$$

where D is the viewing distance, p is the pixel pitch 207, and ictf(x) is the inverse function of ctf(c), which is the contrast threshold function of the human eye and gives the contrast threshold of the human eye for a spatial frequency of 'c' contrast cycles per degree of viewing angle. For purposes of this calculation, one contrast cycle may be considered the width of one laser scanning path 204 illuminated by a low output laser and one laser scanning path 204 illuminated by a higher output laser. It is noted that in embodiments in which lasers 400 are configured to illuminate rows of pixels during one rotation of polygon scanner 150 that are not adjacent to each other and are instead separated by one or more intermediary rows of pixels, p is the pixel pitch times the number of intermediary rows of pixels.

As an illustrative example, assume δ=10%, p=1.6 mm, and D=6 m. Substituting 10% in for δ in Equation 1 yields Equation 3:

$$\Delta = \frac{10}{200 + 10} = 0.047 \tag{3}$$

It is known that ictf(0.047) is approximately 15 cycles per degree. Therefore substituting the known values into Equation 2 yields Equation 4:

$$m = \left\lfloor \frac{6000 \times \pi}{360 \times 15 \times 1.6} \right\rfloor = 2 \tag{4}$$

Hence, in this example, lasers 400 of laser array 110 can be organized into 2 sub-groups when the minimum viewing distance is 6 m, thereby minimizing reduction in image brightness without sacrificing perceived image uniformity.

In step 602, display processor and controller 190 identifies the lowest output laser in laser array 110 and the output level of the lowest output laser. This information can be determined during step 602 or by the laser-output-measuring procedure performed prior to step 601. By way of example, the lowest output laser identified in step 602 is found to be in first laser group 401.

In step 603, display processor and controller 190 adjusts the output level of all other lasers in first laser group 401 to the output level associated with the lowest output laser identified in step 602.

In step 604, display processor and controller 190 adjusts the output level of all lasers in second laser group 402 to a higher output level. In one embodiment, the higher output level may be equal to the nominal desired output level of lasers 400 in laser array 110. Alternatively, the higher output level may be selected to be higher than the nominal desired output level of lasers 400 in order to partially or completely compensate for the reduced brightness of display system 100 due to the reduced optical output of first laser group 401. If m is determined to be three or more, then additional laser groups not illustrated in the embodiment in FIG. 4 will also be adjusted to the higher output level applied to second laser group 402.

In step 605, display processor and controller 190 causes the outputs of the lasers in first laser group 401 to interleave with the output of the lasers in second laser group 402 in order to display an image on fluorescent screen 101 having uniform brightness.

In one embodiment, the procedure for determining the number m of sub-groups of lasers is modified to maximize the number m without creating noticeable contrast between regions 301 and 302 on fluorescent screen 101. In such an embodiment, display processor and controller 190 calculates a threshold contrast value, $\Delta_{m+1}$, for m+1 subsets of lasers. For example, display processor and controller 190 may use Equation 5 to determine $\Delta_{m+1}$:

$$\Delta_{m+1} = ctf\left(\frac{D \times \pi}{360 \times (m+1) \times p}\right) \tag{5}$$

Display processor and controller 190 then calculates a threshold output difference, $\delta_{m+1}$, between any two lasers in laser array 110 when laser array 110 is organized into m+1 subsets of lasers instead of only m subsets of lasers. For example, Equation 4 can be generated by rearranging Equation 1, and display processor and controller 190 may use Equation 6 to determine $\Delta_{m+1}$:

$$\delta_{m+1} = \frac{\Delta_{m+1} \times 200}{1 - \Delta_{m+1}} \quad (6)$$

Display processor and controller 190 then determines if the number m of subsets of lasers can be increased without creating noticeable contrast between the regions on the viewing surface illuminated by the lasers. For example, display processor and controller 190 may determine if the following condition in Inequality 7 is true, in which case m is set to m+1 whenever the outputs of all lasers are within $\delta_{m+1}$ of each other:

$$\frac{m-1}{m} \times \delta < \frac{m+1}{m} \times \delta_{m+1} \quad (7)$$

In some embodiments, a large-scale display wall may include a plurality of display tiles, where each display tile is substantially similar in organization and operation to display system 100. Because the human eye is quite sensitive to changes in contrast, when one display tile of a large-scale display wall has an under-performing laser and undergoes dithered power matching, a similar dithered power matching scheme may be applied to adjacent display tiles to minimize tile-to-tile contrast. Thus, even though a display tile may have no under-performing lasers, a dithered power matching algorithm may still be used by the tile so that no noticeable contrast is present with an adjacent tile.

In sum, embodiments of the invention enable dithered power matching of laser light sources in a display device. By organizing the laser light sources into two or more groups, adjusting the output power of one of the groups to a lower output level, and interleaving the outputs of the laser light sources from each group, the perceived brightness uniformity of a displayed image can be maintained while minimizing losses in image brightness due to an under-performing laser. In addition, when a display system implements embodiments of the invention, small manufacturing variations in laser performance can be readily rendered unnoticeable or even compensated for by slightly increasing the output of laser groups that do not include under-performing lasers. Hence, the complex and time-consuming step of individually testing and matching all lasers prior to installation into a display system can be avoided.

One embodiment of the invention may be implemented as a program product for use with a computer system. The program(s) of the program product define functions of the embodiments (including the methods described herein) and can be contained on a variety of computer-readable storage media. Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored.

While the foregoing is directed to embodiments of the present invention, other and further embodiments of the invention may be devised without departing from the basic scope thereof, and the scope thereof is determined by the claims that follow.

We claim:

1. A method for managing image quality in a laser-based imaging system, the method comprising:

organizing a plurality of lasers into two or more subsets of lasers;

within a first subset of lasers, identifying a first laser having an output level that is lower than any output level associated with any other laser in the first subset of lasers;

for each of the other lasers in the first subset of lasers, adjusting the output level associated with the other laser to be substantially equal to the output level associated with the first laser;

within a second subset of lasers, adjusting the output level associated with each laser in the second subset of lasers to be substantially equal to a second output level; and causing the outputs of the lasers within the first subset of lasers to be interleaved with the outputs of the lasers within the second subset of lasers to display an image on a display surface.

2. The method of claim 1, wherein the first subset of lasers is configured to illuminate a first plurality of regions on the display surface, and the second subset of lasers is configured to illuminate a second plurality of regions on the display surface.

3. The method of claim 2, wherein regions in the first plurality of regions and regions in the second plurality of regions are disposed on the screen in an alternating fashion relative to one another.

4. The method of claim 2, wherein regions in the first plurality of regions have a width of at least one pixel element.

5. The method of claim 2, wherein regions in the first plurality of regions and regions in the second plurality of regions form a pattern of alternating stripes on the display surface.

6. The method of claim 1, wherein the output level associated with the first laser is less than a reference output level, and the second output level is greater than the reference output level.

7. The method of claim 6, wherein the second output level is selected such that the average of the output level associated with the first laser and the second output level is substantially equal to the reference output level.

8. The method of claim 1, further comprising computing a number of subsets of lasers comprising the two or more subsets of lasers based on a viewing distance from the display surface, a width of a region on the display surface illuminated by a single laser in the plurality of lasers, a contrast threshold function of the human eye, and a difference between the output level associated with the first laser and the second output level.

9. The method of claim 8, further comprising:

calculating a threshold contrast value for the computed number of subsets of lasers plus one additional subset of lasers;

calculating a threshold output difference between the output level associated with the first laser and the second output level; and determining that the number of subsets of lasers comprising the two or more subsets of lasers can be increased without causing a substantial contrast between the regions on the display surface illuminated by the lasers in the plurality of laser; and setting the number of subsets of lasers comprising the two or more subsets of lasers to the computed number of subsets of lasers plus one additional subset of lasers.

10. The method of claim 9, wherein the threshold contrast value is calculated as a function of the viewing distance from the display surface, the computed number of subsets of lasers plus one additional subset of lasers, and the width of a region on the display surface illuminated by a single laser in the plurality of lasers.

11. A non-transitory computer-readable storage medium comprising instructions to be executed by a computing device to cause the computing device to carry out the steps of:

organizing a plurality of lasers into two or more subsets of lasers;

within a first subset of lasers, identifying a first output level associated with a first laser, wherein the first output level is lower than any output level associated with any other laser in the first subset of lasers;

for each of the other lasers in the first subset of lasers, matching the output level associated with the first laser to the first output level;

within a second subset of lasers, matching the output level associated with each laser to a second output level; and causing the outputs of the lasers within the first subset of lasers to interleave with the output of the lasers within the second subset of lasers in order to display the image on a display surface.

12. The non-transitory computer-readable storage medium of claim 11, wherein the first subset of lasers is configured to illuminate a first plurality of regions on the display surface, and the second subset of lasers is configured to illuminate a second plurality of regions on the display surface.

13. The non-transitory computer-readable storage medium of claim 12, wherein regions in the first plurality of regions and regions in the second plurality of regions are disposed on the screen in an alternating fashion relative to one another.

14. The non-transitory computer-readable storage medium of claim 12, wherein regions in the first plurality of regions have a width of at least one pixel element.

15. The non-transitory computer-readable storage medium of claim 12, wherein regions in the first plurality of regions and regions in the second plurality of regions form a pattern of alternating stripes on the display surface.

16. The non-transitory computer-readable storage medium of claim 11, wherein the output level associated with the first laser is less than a reference output level, and the second output level is greater than the reference output level.

17. The non-transitory computer-readable storage medium of claim 16, wherein the second output level is selected such that the average of the output level associated with the first laser and the second output level is substantially equal to the reference output level.

18. The non-transitory computer-readable storage medium of claim 11, further comprising computing a number of subsets of lasers comprising the two or more subsets of lasers based on a viewing distance from the display surface, a width of a region on the display surface illuminated by a single laser in the plurality of lasers, a contrast threshold function of the human eye, and a difference between the output level associated with the first laser and the second output level.

19. The non-transitory computer-readable storage medium of claim 18, further comprising:

calculating a threshold contrast value for the computed number of subsets of lasers plus one additional subset of lasers;

calculating a threshold output difference between the output level associated with the first laser and the second output level; and determining that the number of subsets of lasers comprising the two or more subsets of lasers can be increased without causing a substantial contrast between the regions on the display surface illuminated by the lasers in the plurality of laser; and setting the number of subsets of lasers comprising the two or more subsets of lasers to the computed number of subsets of lasers plus one additional subset of lasers.

20. The non-transitory computer-readable storage medium of claim 19, wherein the threshold contrast value is calculated as a function of the viewing distance from the display surface, the computed number of subsets of lasers plus one additional subset of lasers, and the width of a region on the display surface illuminated by a single laser in the plurality of lasers.

21. A laser-based display system, comprising:

a display surface;

a plurality of lasers for producing light to form an image on the display surface; and a processing unit configured to perform the steps of:

organizing the plurality of lasers into two or more subsets of lasers;

within a first subset of lasers, identifying a first laser having an output level that is lower than any output level associated with any other laser in the first subset of lasers;

for each of the other lasers in the first subset of lasers, adjusting the output level associated with the other laser to be substantially equal to the output level associated with the first laser;

within a second subset of lasers, adjusting the output level associated with each laser in the second subset of lasers to be substantially equal to a second output level; and causing the outputs of the lasers within the first subset of lasers to be interleaved with the outputs of the lasers within the second subset of lasers to display an image on a display surface.

22. The display device of claim 21, further comprising a memory unit configured to store instructions that, when executed by the processing unit, cause the processing unit to perform the steps of organizing, identifying, adjusting, and causing.

23. The display device of claim 21, wherein the processing unit comprises a special purpose graphics unit, a graphics processing unit, an application specific integrated circuit, or a field-programmable gate array.

* * * * *